US005537005A

United States Patent [19]

Goebel et al.

[11] Patent Number: 5,537,005

[45] Date of Patent: Jul. 16, 1996

[54] HIGH-CURRENT, LOW-PRESSURE PLASMA-CATHODE ELECTRON GUN

[75] Inventors: Dan M. Goebel, Tarzana; Robert W. Schumacher, Woodland Hills, both of Calif.

[73] Assignee: Hughes Aircraft, Los Angeles, Calif.

[21] Appl. No.: 242,569

[22] Filed: May 13, 1994

[51] Int. Cl.[6] ..... H01J 27/02

[52] U.S. Cl. ..... 315/111.81; 250/427; 313/632; 313/362.1; 313/230

[58] Field of Search ..... 315/111.81, 39; 250/427; 313/360.1, 362.1, 230, 231.71, 588, 632

[56] References Cited

U.S. PATENT DOCUMENTS

| | | | |
|---|---|---|---|
| 3,831,052 | 8/1974 | Knechtli | 313/595 |
| 3,913,320 | 10/1975 | Reader et al. | 313/362.1 X |
| 4,684,848 | 8/1987 | Kaufman et al. | 315/111.81 |
| 4,749,910 | 6/1988 | Hara et al. | 313/362.1 X |
| 4,870,284 | 9/1989 | Hashimoto et al. | 315/111.81 X |
| 4,873,467 | 10/1989 | Kaufman et al. | 313/360.1 |
| 4,912,367 | 3/1990 | Schumacher et al. | 315/3.5 |
| 5,097,179 | 3/1992 | Takayama | 315/111.81 |
| 5,317,235 | 5/1994 | Treglio | 315/111.81 X |

OTHER PUBLICATIONS

S. Tanaka et al., "Design and experimental results of a new electron gun using a magnetic multipole plasma generator", *Review Scientific Instruments, American Institute of Physics,* Mar., 1991, pp. 761–771.

Goebel, Dan M., et al., *Proceedings 9th International Conference on High–Power Particle Beams,* Washington, D.C., May 25, 1992, pp. 1093–1098.

*Primary Examiner*—Benny T. Lee

*Attorney, Agent, or Firm*—V. D. Duraiswamy; W. K. Denson-Low

[57] ABSTRACT

Plasma-cathode electron gun structures capable of operation in low-pressure, e.g., $<5\times10^{-3}$ Torr, ionizable gas environments are disclosed. They utilize a thermionic emitter within an enclosure with a partially transparent electrode defining a plasma face. Spaced anodes are disposed adjacent the electrode to extract an electron beam from the plasma face. A magnetic system forms an inward directed field, and a portion of the plasma electrons are directed through this field to enhance ionization efficiency.

5 Claims, 3 Drawing Sheets

HIGH-CURRENT, LOW-PRESSURE PLASMA-CATHODE ELECTRON GUN

BACKGROUND OF THE INVENTION

1. Field of the Invention

The present invention relates generally to electron guns and more particularly to plasma-cathode electron guns.

2. Description of the Related Art

A plasma-cathode electron gun was disclosed in U.S. Pat. No. 4,912,367 issued Mar. 27, 1990 in the name of Robert W. Schumacher et al., and assigned to Hughes Aircraft Company, the assignee of the present invention. The electron gun operated with a pulsed discharge in an ionizable gas contained in a hollow cathode enclosure. This discharge produces a uniform plasma of electrons and positive ions. The electron beam pulse was extracted from the plasma by a beam voltage impressed between a discharge grid and an anode positioned adjacent an outlet of the enclosure.

The above cited patent also described an exemplary application of the plasma-cathode electron gun in which its electron beam was injected into a slow-wave structure that operates in the presence of a low-pressure ionizable gas. The slow wave structure reduces electromagnetic phase velocity so as to match the speed of the electron beam. Space-charge waves on the beam can then be resonantly coupled to waveguide modes in a process that transfers energy from the electron beam to a microwave signal that is subsequently coupled out of the slow-wave structure.

The electron beam is confined and transported through the slow-wave structure by electron beam ionization of the gas surrounding the slow-wave structure to produce ions that neutralize the beam and prevent space charge blowup. A magnetic confining force is produced by the axial beam current which produces an azimuthal magnetic field directed back upon the beam to generate thereon a radially inward-directed force. Backflowing ions from the slow-wave plasma are harmlessly absorbed by the plasma cathode.

In this exemplary application, gas pressure in the slow-wave structure must be above a minimum required to produce sufficient plasma to control space-charge blowup and below a maximum that causes the plasma to short the slow-wave structure. This pressure range, typically positioned below $5\times10^{-4}$ Torr, has generally been found to be below the pressure range required for optimum operation of the cold-cathode discharge in the plasma-cathode electron gun, e.g., $5\times10^{-3}$ Torr.

This pressure differential conflict has been addressed by coupling a transient injection system to the electron gun. This system injects sufficient gas into the enclosure to strike the cold-cathode discharge. The injection is timed so that the beam pulse is past before the injected gas diffuses into the slow-wave structure region.

This transient system can be formed around a gas-puff valve coupled to the plasma-cathode enclosure. The valve is connected to a gas-puff supply and the timing coordination between the discharge pulse and the gas-puff valve is achieved via a fiber optic light link. A portion of the injected gas diffuses through the enclosure outlet into the slow-wave structure which must be pumped back down to the preferred slow-wave pressure range before the next pulse is initiated. Thus, not only does the transient system involve the addition of considerable hardware with consequent size and weight increase but the system pulse repetition rate is limited, e.g., typically to less than 100 Hz, by the injection and pumping functions. A more detailed description of the transient gas injection system may be found in Goebel, Dan M., et al., *Proceedings 9th International Conference on High-Power Particle Beams*, Washington, D.C., May 25, 1992, pp. 1093–1098.

This paper also describes a mesh coupled to the discharge anode to define a plasma face. Definition of this face helps to insure that the electrons enter an adjacent acceleration region from the same location independent of the system voltage and current. This reduces variations in the system's beam optics. The mesh also stabilizes the electron beam extraction by providing a measure of isolation between the plasma discharge process and the electron beam extraction process.

Another electron gun structure is described by S. Tanaka, et al. (see S. Tanaka, et al., "Design and experimental results of a new electron gun using a magnetic multipole plasma generator", *Review Scientific Instruments, American Institute of Physics*, March 1991, pp. 761–771).

This structure includes a plasma generator chamber coupled to a three grid accelerator. The plasma generator has a copper chamber with Sm-Co permanent magnets attached to its outer surface to form a magnetic multipole configuration in the chamber. The chamber is preferably filled with hydrogen with tungsten filaments inserted therein.

The accelerator is composed of three grids, respectively called plasma grid, gradient grid and earth grid, which are held in alumina ceramic insulators. The gradient grid is disposed between the plasma and earth grids with the plasma grid spaced closest to the chamber. Various aperture configurations are disclosed for each of these grids.

The plasma and gradient grids are negatively biased with respect to the earth potential. The potential of the gradient grid is set between the plasma grid potential and earth potential. A ration of gradient grid potential to plasma grid potential is defined. By varying the ratio, it is stated that the electron beam optics can be controlled for a given combination of acceleration voltage and beam current.

As reported in the above paper, the gun structure described therein is limited to a beam current a 4 amperes which is obtained in a gas pressure environment of approximately $1\times10^{-3}$ Torr. In addition, over 8 kW of discharge power was required to produce 2 ampers of beam current for an efficiency of less than 0.25 A/kW. This beam current is not compatible with high power microwave tube requirements and the gas pressure is not compatible with a low gas pressure required in the slow-wave structures described above.

Other reference s directed to plasma-cathode structures include U.S. Pat. No. 3,831,052 issued Aug. 20, 1974 in the same of Ronald C. Knechtli and assigned to Hughes Aircraft Company, the assignee of the present invention. This patent disclosed an electron gun directed to ionization of the gas in a laser cavity. The plasma of the electron gun is produced by a high pressure ($<1\times10^{-2}$ Torr) glow discharge. Accordingly, electron guns in accordance with this patent are not compatible with the low gas pressure required in the slow-wave structures described above.

SUMMARY OF THE INVENTION

The present invention is directed to plasma-cathode electron gun structures suitable for electron beam injection into slow-wave structures that utilize plasma channel beam guidance in their conversion of electron beam energy into microwave energy. Such slow-wave structures operate optimally at low gas pressures. Apparatus for achieving gas pressure differentials can be eliminated and optimum pulse repetition frequencies realized if the electron gun can operate in a similar pressure environment. Accordingly, the invention is directed to electron gun structures that can operate in low-pressure, e.g., $<5\times10^{-4}$ Torr, ionizable gas environments while generating a high-current electron beam.

These goals are realized with the recognition that thermionic electron emission facilitates ionization at low gas pressures, that gas ionization efficiency can be increased by directing a first portion of the plasma electrons to flow against a magnetic field arranged to oppose that flow, and that output current is increased by directing a second portion of the plasma electrons to a plasma face from which they are extracted to form the beam current.

Electron guns in accordance with the invention are characterized by an enclosure configured to receive a low-pressure ionizable gas, a thermionic emitter disposed within the enclosure, an outlet defined in the wall of the enclosure, and a partially transparent electrode disposed across the outlet to define the plasma face. A discharge anode is coupled to the partially transparent electrode and an acceleration region is formed between the discharge anode and a beam anode spaced therefrom. The emitter and the discharge anode are configured to receive a discharge voltage applied across them for ionization of the gas into a plasma, and the discharge anode and the beam anode are configured to receive a beam voltage applied across them for extraction of the electron beam from the plasma face. The beam current is modulated on and off by controlling the discharge voltage level.

In accordance with a feature of the invention that facilitates the production of high currents in low gas pressures, a magnetic system opposes the flow of electrons from the plasma, and a selectably scaled sample of the discharge voltage is coupled to the enclosure to drive a first portion of the plasma electrons through the magnetic field. In addition, the beam current is increased by referencing the discharge voltage to the discharge anode which directs a second portion of the plasma electrons to the acceleration region. In a preferred embodiment, the discharge voltage sample is obtained by coupling the enclosure to the emitter through a selectable resistor.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
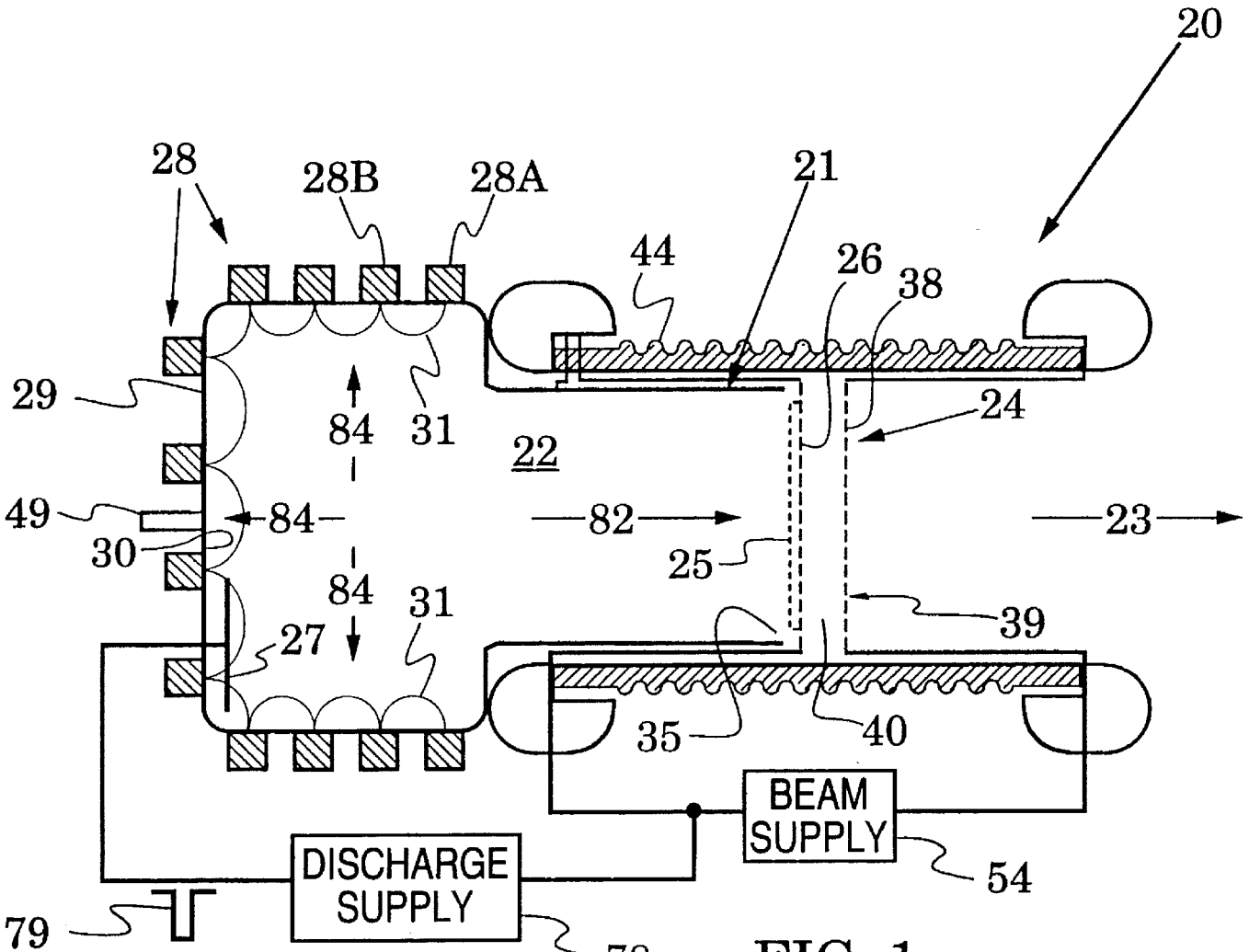
FIG. 1 is a sectional diagram of a preferred plasma-cathode electron gun embodiment in accordance with the present invention.

FIG. 1 is a sectional diagram of a preferred plasma-cathode electron gun embodiment 20 in accordance with the present invention. The electron gun 20 has a plasma cathode 21 that includes a low-pressure ionizable gas 22 which is ionized to a plasma by a discharge voltage placed across it. An electron beam 23 is extracted from the plasma with a beam voltage impressed across an accelerator 24. A plasma face is defined by a partially transparent electrode in the form of a mesh 25 that is coupled to a discharge anode 26. The partially transparent electrode 25 provides isolation between the plasma discharge process and the electron beam extraction process.

Thermionic electron emission from an emitter 27 facilitates plasma formation at low pressures of the gas 22. The efficiency of the ionization is enhanced by directing a first portion of the plasma electrons to flow through a magnetic field that is established by magnets 28 to oppose that flow. The current in the electron beam 23 that is extracted from this plasma is increased by directing a second portion of the plasma electrons towards the plasma face defined by the electrode 25.

An electron gun in accordance with the invention is capable of extracting a high-current electron beam 23 from a low-pressure, e.g., $<5\times10^{-4}$ Torr, gas which makes it suitable for coupling with a slow-wave structure that utilizes plasma channel beam guidance in converting electron beam energy into microwave energy, i.e., the electron gun and slow-wave structure can operate without a pressure differential between them.

Attention is now directed to a detailed description of the electron gun 20. As shown in FIG. 1, an electron beam 23 is formed from a plasma-cathode 21 that includes an enclosure 29 configured to receive and confine a low pressure ionizable gas 22. Spaced inward from a wall 30 of the enclosure 29 is a thermionic electron emitter 27, e.g., a barium oxide, tungsten or lanthanum hexaboride filament or wafer.

A system of magnets 28 is arranged about the enclosure 29 to develop a magnetic field whose flux lines 31 are oriented to inhibit the flow of electrons from the plasma to the enclosure 29. In a preferred embodiment, each magnet, e.g., magnet 28A, is annular in form and is aligned in a plane orthogonal to the electron beam 23. The surface of adjacent rings lying nearest the enclosure 29 alternate in polarity, i.e., if the inner surface of ring 28A is a north pole, then the inner surface of ring 28B is a south pole and so on. Thus, the magnetic flux lines 31 extend inward from the enclosure walls 30 in a cusp shape as they connect the alternating north and south poles about the enclosure 29. An even number of rings is used to avoid an unbalanced pole that would create a field directed parallel to the electron beam 23. The magnets 28 are preferably permanent magnets for construction simplicity.

The accelerator 24 is positioned adjacent to an outlet 35 defined in the enclosure wall 30. The accelerator includes a discharge anode 26 and spaced therefrom, a beam anode 38. The discharge anode 26 and beam anode 38 each define a plurality of apertures 39 and the spacing between the anodes 26, 38 defines an acceleration region 40 between them. The anodes 26, 38 are supported on a high-voltage insulating bushing 44 formed, for example, of ceramic. The partially transparent electrode 25 is physically and electrically coupled, e.g., soldered or welded, to the discharge anode 26 on its side facing the enclosure 29 interior. A gas feed 49, e.g., a valve, is disposed through the wall 30 to transport the ionizable gas 22 into the enclosure 29.

Figure 2:
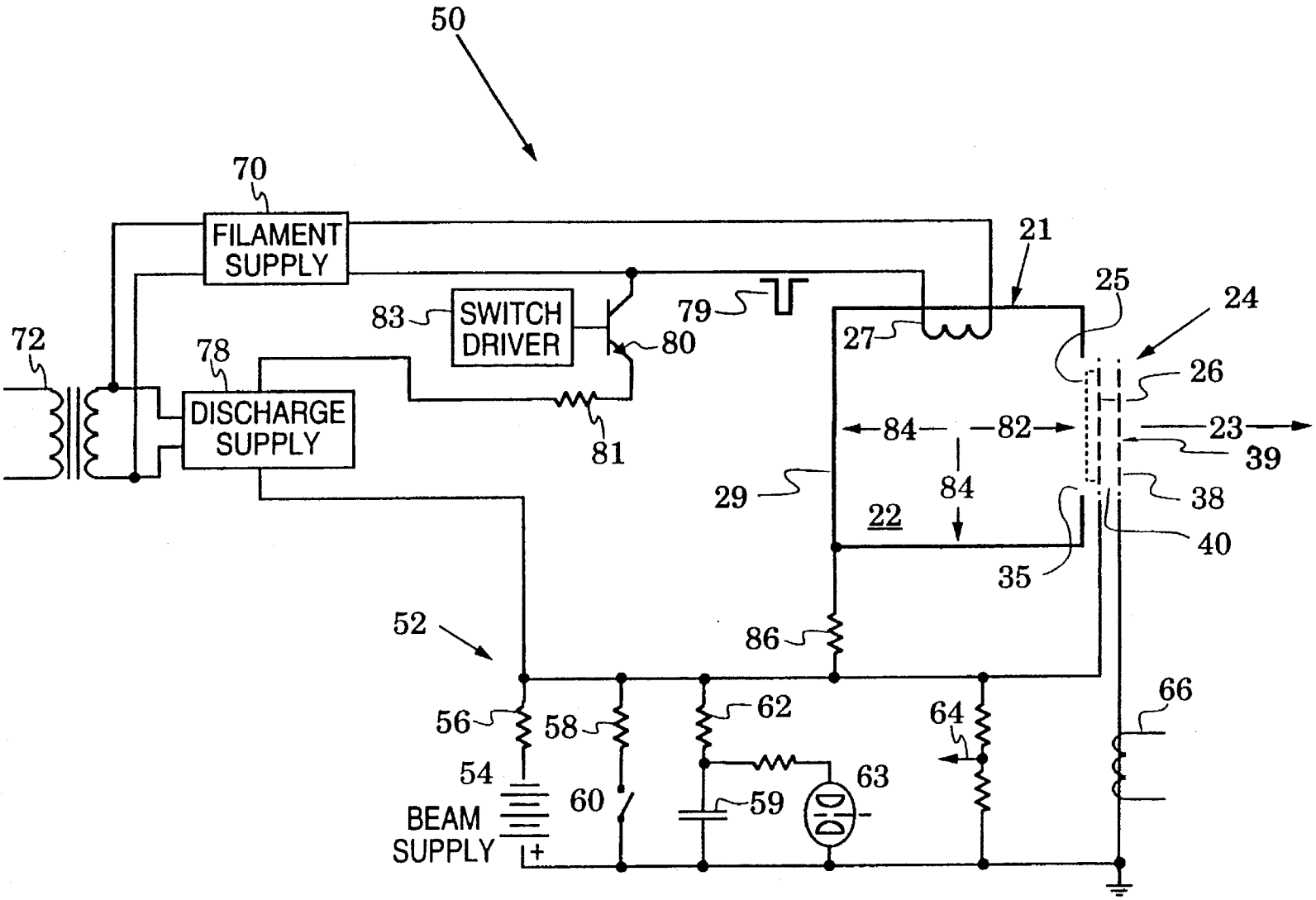
FIG. 2 is an electrical schematic of the electron gun of FIG. 1.

FIG. 2 is an electrical schematic 50 of the electron gun 20. As recited previously in relation to FIG. 1, the plasma-cathode 21 includes the enclosure 29 which is configured to receive and confine the low-pressure ionizable gas 22. The accelerator 24 is positioned adjacent to the outlet 35 which is defined in the wall of the enclosure 29. It shows a beam supply 52 in which a beam supply 54 that biases the anodes 26, 38 through a resistor 56 to accelerate electrons across the acceleration gap 40. The beam supply can be dumped via a switch 60 into a load resistor 58. Associated with the beam supply is a capacitor bank 59. A "crowbar" circuit 63 is positioned in association with resistive divider 62 to reduce the voltage across the capacitor bank if a high voltage fault develops (a "crowbar" is any of several well known circuits that rapidly place a low-resistance shunt across the output terminals of a power supply when a preset voltage limit is exceeded). The beam voltage and current are monitored respectively by a voltage divider 64 and a current transformer 66.

A filament supply 70, powered from an isolation transformer 72, is connected across the thermionic emitter 27 and a discharge supply 78 supplies a negative pulse 79 across the emitter 27 and discharge anode 26 by way of a modulator in the form of a transistor switch 80 in series with a resistor 81. The gating of the transistor switch 80 is controlled by a switch driver 83. The enclosure 29 is connected to the discharge anode 26 by a resistor 86.

In operation of the electron gun 20, the enclosure 29 is filled with a low-pressure, e.g., $<5\times10^{-4}$ Torr, ionizable gas 22, e.g., xenon, hydrogen or helium, and the emitter 27 is heated with current from the filament supply 70. Thermionically emitted electrons from the emitter 27 form an electron source which facilitates a plasma discharge from the gas 22 at low gas pressures.

Discharge pulses 79 are then applied between the emitter 27 and discharge anode 26 via the discharge supply 78 and the gating switch 80. Each discharge pulse ionizes the gas 22 to form a plasma which supplies an electron current 82 to the discharge anode 26 and an electron current 84 to the walls 30 (see FOG. 1) of the enclosure 29. A portion of the electrons in the current 82 are intercepted by the discharge anode 26 and the remainder are accelerated across the acceleration region 40 by the beam supply voltage 54 to pass through the beam apertures 39 (see FIG. 2) and form the electron beam 23.

Commonly used descriptive terminology that is useful in describing this operation includes the terms "grids" for anodes 26, 38, "bucket" for enclosure 29, "grid current" for the difference between the electron current 82 and the electron bean 23, and "bucket current" for the electron current 84. The electron current 84 is opposed on its flow to the enclosure 29 by the magnetic field of the magnets (28 in FIG. 1. i.e., the plasma electrons are deflected by the flux lines 31. The opposition enhances the ionization efficiency by forcing the electrons to pass through the gas volume many times before they are lost to the enclosure walls 30. The higher ionization efficiency facilitates the user of lower gas pressures.

The ionization efficiency is further enhanced by directing the electron current 84 through the magnetic field flux lines 31 to the enclosure 29 as shown in FIG. 1. This is accomplished by completing a current path between the enclosure 29 ad the discharge anode 26 with a voltage differential device in the form of resistor 86. Electron current 84 is selectively controlled by the voltage differential across the resistor 86, which causes the enclosure 29 potential to be somewhat less than that of the discharge anode 26. In a preferred embodiment, selecting resistor 86 to be between 1 and 2 ohms provides an electron current 82 large enough to produce sufficient plasma to support a high electron current 82 and, hence, a high-current electron beam 23. Typically, the electron current 84 is approximately 20% of the beam current. For clarity of description, some of the elements shown in the schematic 50 of FIG. 2 are also shown in association with the electron gun 20 of FIG. 1. In particular, these elements are the beam supply 54, the discharge supply 78, discharge pulses 79, electron current 82 and electron current 84.

The mesh 25 defines the plane of the electron source for the accelerator 24, i.e., the plasma face. This allows the gun 20 to operate with reasonably arbitrary voltage and current combinations (e.g., voltages in the range of 20–120 kV and currents in the range of 1–120 amperes) because the mesh defines and stabilizes the location of an acceleration plane. The electrons thus enter the acceleration region 40 from the same location, i.e, the plane of the mesh 25, independent of the system voltage and current. This means the designed beam optics remain stable. Variation in beam optics increases grid interception of electrons which can lead to arcing.

In addition, the mesh 25 stabilizes the electron extraction from the plasma face by providing a measure of isolation between the plasma discharge process and the electron beam extraction process. Without the mesh 25, interaction between the beam voltage and discharge voltage provides a potential for unstable operation. To accomplish these objectives, the mesh 25 is preferably formed from a low resistance material, e.g., molybdenum, and defines openings with a diameter in the range between 0.3 millimeter and 0.6 millimeter.

The electron gun 20 is especially suited for use with high power microwave amplifiers and oscillators. In particular, it can be used to inject an electron beam into a slow-wave structure for converting a portion of the beam energy into microwave energy. The use of large and complicated magnetic beam focusing structures in association with the slow-wave structure may be avoided by directing the beam through a low-pressure ionizable gas to form a self-directing plasma channel through the slow-wave structure. The structure of the gun 20 facilitates the elimination of gas differential pressure between the gun and the slow-wave structure.

Back streaming plasma ions from the slow-wave plasma channel can damage a conventional thermionic emitter. When the plasma-cathode electron gun 20 is used in such a microwave source, the majority of the backstreaming ions are absorbed into the plasma face defined by the mesh 25. Preferably, the emitter 27 is placed off center from the outlet 35 to further protect it from backstreaming ions.

An exemplary electron gun was constructed in accordance with the teachings of the invention as illustrated relative to FIGS. 1 and 2. It included an accelerator 24 in which the grids 26, 38 are formed of molybdenum with apertures 39 having a 0.46 centimeter diameter. The grids 26, 34 are spaced approximately one centimeter apart and supported on the ceramic bushing 44. The mesh 25 had openings of approximately 0.5 mm diameter and was formed from molybdenum.

Figure 3:
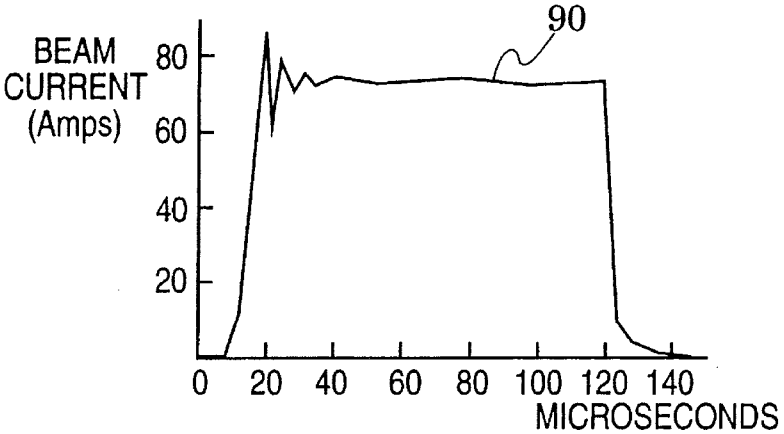
FIG. 3 is a graph of the an electron-beam pulse obtained with an exemplary electron gun fabricated in accordance with the present invention.
Figure 4:
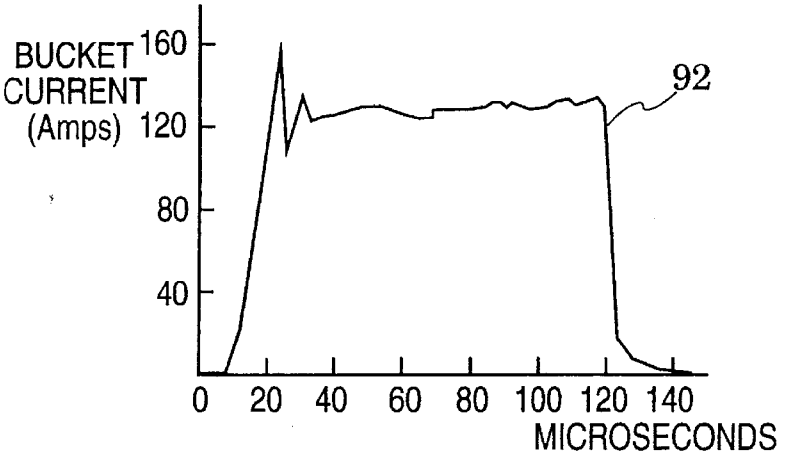
FIG. 4 is a graph of an electron-current pulse which is associated with the electron-beam pulse of FIG. 3.

The cathode enclosure was filled with xenon at a static pressure of $2.6\times10^{-5}$ Torr and the gun was operated at 1 KHz pulse frequency with a pulse length exceeding 100 microseconds. An exemplary pulse 90 of the electron beam (23 in FIGS. 1 and 2 and exemplary pulse 92 of the electron current (84 in FIG. 1 and 2) to the enclosure (29 in FIGS. 1 and 2) are shown respectively in the graphs of FIGS. 3 and 4. A shown in these figures, the pulse 90 was approximately 75 amperes and the pulse 92 was approximately 125 amperes.

In this operation, the discharge voltage and grid current were measured at approximately 85 volts and 20 amperes. Therefore, the efficiency was 75 amperes/(85 volts)(75+125+20 amperes)=4 amperes beam current per kilowatt of discharge power. Operating with beam voltages between 50 kV and 80 kV has yielded beam currents exceeding 100 amperes with pulse lengths exceeding 200 microseconds. Pulse lengths exceeding 1 millisecond with a beam current of approximately 50 amperes have been obtained with beam voltages over 60 kV.

Figure 5:
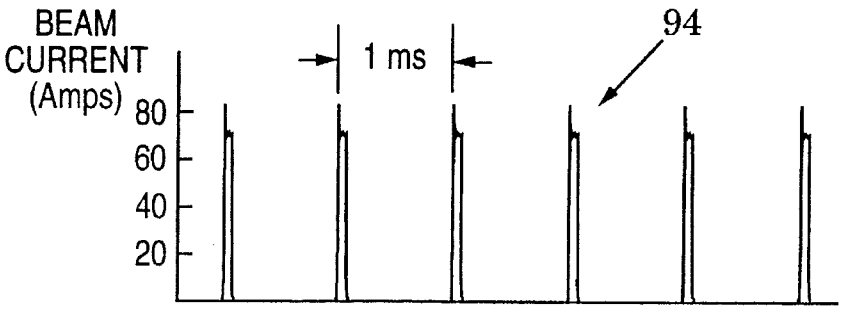
FIG. 5 is a graph illustrating a train of electron-beam pulses obtained with the exemplary electron gun referenced relative to FIG. 3.
Figure 6:
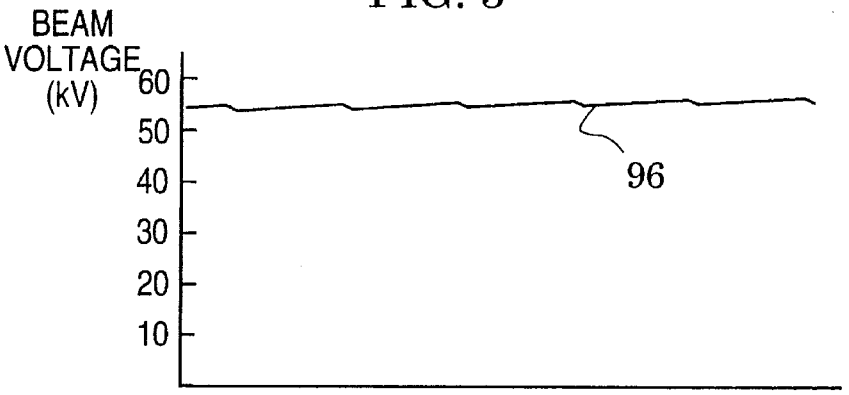
FIG. 6 is a graph of beam voltage corresponding to the beam current pulses of FIG. 5.

FIGS. 5 and 6 show the results of a high pulse repetition frequency (PRF) operation of the exemplary electron gun. FIG. 5 illustrates a burst 94 of 100 microsecond electron-beam pulses at a 1 KHz PRF. As shown in FIG. 6, the beam voltage 96 was approximately 55 kV and evidenced only negligible sag during the pulse burst. A 10% duty cycle operation has been obtained for bursts of 250 pulses. The number of pulses was limited by the beam dump and it is anticipated that longer pulse bursts are possible with sufficient power supplies.

The exemplary electron gun was fabricated with ultra-high vacuum flanges, pumped down to a pressure below $10^{-8}$ Torr, baked to over 300° C. and valved off. This provided a desirable sealed-tube construction. The device vacuum was maintained with a ZrAl getter pump which efficiently pumped all gases except the plasma discharge gas via the gas feed (49 in FIG. 1). The $<5\times10^{-5}$ Torr xenon fill pressure for this sealed system was provided by a small xenon leak valve and a vacuum ion pump. An 8 liter/sec vacuum ion pump has demonstrated stable operation for hundreds of hours while pumping this gas load. The exemplary electron gun has also been operated with a hydrogen gas fill at pressures of approximately $4\times10^{-4}$ Torr. In this operation, the ZrAl getter pump acts as a reservoir of hydrogen while both pumping the volatile gases and regulating the gun hydrogen pressure.

The enclosure (29 in FIG. 1) of the exemplary electron gun was approximately 15 cm in diameter and 20 cm long. The magnet rings (28 in FIG. 1) were formed of SmCo (samarium cobalt) and spaced approximately 3 cm apart to obtain a surface field strength of approximately 3 kilogauss.

The electron gun embodiments described above are capable of operating in low-pressure gas environments. This capability makes them especially suitable for coupling with slow-wave structures that operate optimally in similar environments. The consequent elimination of pressure differential apparatus that has previously been required in high pressure systems facilitates operating at high pulse repetition frequencies.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A plasma-cathode electrode gun for extracting an electron beam from an ionizable gas having a pressure less than $5\times10^{-4}$ Torr, comprising:

an enclosure having a wall and and configured to contain said ionizable gas;

a thermionic electron emitter positioned within said enclosure;

an outlet defined in said wall;

a discharge anode defining a plurality of apertures and positioned across said outlet;

a beam anode defining a plurality of apertures and spaced from said discharge anode to define an acceleration region between said discharge anode and said beam anode;

a magnet system that is arranged around said enclosure and configured to generate magnetic flux line in said enclosure which are adjacent said wall;

a discharge supply arranged to apply discharge voltage pulses across said emitter and said discharge anode to generate a plasma of ions and electrons by ionization of said ionizable gas;

a beam supply coupled to said discharge anode and said beam anode to generate an electric field across said acceleration region for extraction of a first portion of said electrons as said electron beam; and a voltage differential device that connects said wall and said discharge anode for coupling a sample of said discharge voltage pulses to said wall to direct a second portion of said electrons through said magnetic flux lines for enhancement of said ionization and said extraction.

2. The electron gun of claim 1 wherein said voltage differential device comprises a resistor having a selectable range of resistance and said resistor connects said enclosure with said discharge anode.

3. The electron gun of claim 2, wherein said selectable range is between 1 and 2 ohms.

4. The electron gun of claim 1, further including a mesh coupled across said discharge anode to establish a face of said plasma.

5. A method of extracting an electron beam from an ionizable gas having a pressure less than $5\times10^{-4}$ Torr, the method comprising the steps of:

containing said ionizable gas within an enclosure;

emitting electrodes from a thermionic emitter into said ionizable gas;

impression discharge voltage pulse across said ionizable gas to form a plasma of ions and electrons by ionization of said gas;

with a magnetic flux source, forming magnetic flux lines within said enclosure;

applying an electric field to said ionizable gas to extract a first portion of said electrons and form said electron beam; and coupling a selectable sample of said discharge voltage pulse to said enclosure to direct to a second portion of said electrons through said magnetic flux lines for enhancement of said ionization and said extraction.

* * * * *